US009504331B2

(12) United States Patent
Machael et al.

(10) Patent No.: US 9,504,331 B2
(45) Date of Patent: Nov. 29, 2016

(54) DYNAMIC CHAIR BACK LUMBAR SUPPORT SYSTEM

(75) Inventors: Jay R. Machael, Muscatine, IA (US); Jesse Hahn, Cedar Rapids, IA (US); Corey Susie, North Liberty, IA (US); Bruce Fifield, Milan (IT); Federico Ferretti, Cesena (IT); Allessandro Sgotto, Cologno Monzese (IT); Dagmara Siemieniec, Milan (IT); Martin Broen, Milan (IT)

(73) Assignee: HNI TECHNOLOGIES INC., Muscatine, IA (US)

( * ) Notice: Subject to any disclaimer, the term of this patent is extended or adjusted under 35 U.S.C. 154(b) by 0 days.

(21) Appl. No.: 13/557,975

(22) Filed: Jul. 25, 2012

(65) Prior Publication Data

US 2013/0169014 A1 Jul. 4, 2013

Related U.S. Application Data

(63) Continuation of application No. 12/048,113, filed on Mar. 13, 2008, now Pat. No. 8,251,448.

(60) Provisional application No. 60/894,659, filed on Mar. 13, 2007.

(51) Int. Cl.
*A47C 7/14* (2006.01)
*A47C 7/46* (2006.01)

(52) U.S. Cl.
CPC .. *A47C 7/14* (2013.01); *A47C 7/46* (2013.01)

(58) Field of Classification Search
USPC ..... 297/284.4, 296, 297, 298, 299, 300.1, 297/300.2, 300.4, 452.56, 452.55, 301.1, 297/320, 321
See application file for complete search history.

(56) References Cited

U.S. PATENT DOCUMENTS 186,462 A 1/1877 Clay
909,751 A 1/1909 Butcher et al.
(Continued)

FOREIGN PATENT DOCUMENTS

BD 1302 S 2/2015
CN 2629546 Y 9/2004
(Continued)

OTHER PUBLICATIONS

International Search Report and Written Opinion for PCT/US2008/056890 of HNI Technologies Inc., mailed Jul. 17, 2008.
(Continued)

*Primary Examiner* — David E Allred
(74) *Attorney, Agent, or Firm* — Faegre Baker Daniels LLP

(57) ABSTRACT

A chair back according to embodiments of the present invention includes a rigid support member for reclinable attachment to a base, a flexible frame member having a flexible frame and a mesh, the mesh at least partially spanning the frame, and a seat attachment member moving in synchronization with the rigid support member at a different rate than the rigid support member during reclining of the rigid support member, wherein a first portion of the flexible frame member is affixed to the rigid support member, wherein a second portion of the flexible frame member flexes freely, wherein the seat attachment member contacts at least part of the second portion of the flexible frame member, wherein the first portion moves with the rigid support member and the second portion moves with the seat attachment member such that a curvature of the second portion increases as the rigid support member reclines.

25 Claims, 11 Drawing Sheets

(56) References Cited

U.S. PATENT DOCUMENTS 1,290,532 A 1/1919 Fischer
1,376,382 A 4/1921 Horine
2,312,030 A 2/1943 Cramer et al.
2,471,024 A 5/1949 Cramer
2,796,920 A 6/1957 Cowles
3,102,753 A 9/1963 Schliephacke
3,258,259 A 6/1966 Bohlin
3,453,024 A 7/1969 Williams
3,565,482 A 2/1971 Blodee
4,014,507 A 3/1977 Swenson
4,155,592 A 5/1979 Tsuda et al.
4,168,050 A 9/1979 Nerem et al.
D255,184 S 6/1980 Locher
4,429,917 A 2/1984 Diffrient
4,502,729 A * 3/1985 Locher ..... 297/300.3
4,623,193 A 11/1986 Lieker
4,653,806 A 3/1987 Willi
4,761,033 A 8/1988 Lanuzzi et al.
4,773,706 A 9/1988 Hinrichs
4,865,384 A * 9/1989 Desanta ..... 297/300.4
4,909,472 A 3/1990 Piretti
4,962,962 A 10/1990 Machate et al.
4,988,145 A * 1/1991 Engel ..... 297/300.4
5,029,942 A 7/1991 Rink
5,110,182 A 5/1992 Beauvais
5,150,948 A 9/1992 Volkle
5,277,865 A 1/1994 Hara et al.
5,308,144 A * 5/1994 Korn ..... 297/300.2
5,366,274 A * 11/1994 Roericht et al. ..... 297/321
5,486,035 A * 1/1996 Koepke et al. ..... 297/320
5,507,559 A 4/1996 Lance
5,599,069 A 2/1997 Lorbiecki
5,601,337 A 2/1997 Choda et al.
5,649,740 A 7/1997 Hodgdon
5,660,439 A * 8/1997 Unwalla ..... 297/316
5,716,098 A 2/1998 Lance
5,755,488 A 5/1998 Beda et al.
5,772,282 A 6/1998 Stumpf et al.
5,775,774 A 7/1998 Okano
5,797,652 A 8/1998 Darbyshire
5,810,440 A * 9/1998 Unwalla ..... 297/316
5,826,940 A * 10/1998 Hodgdon ..... 297/303.1
5,934,758 A 8/1999 Ritch et al.
RE36,335 E * 10/1999 Perry ..... 297/448.2
5,979,984 A 11/1999 DeKraker et al.
6,030,037 A 2/2000 Ritch et al.
6,035,901 A 3/2000 Stumpf et al.
6,142,566 A 11/2000 Ritch et al.
6,176,548 B1 1/2001 Thole et al.
6,254,186 B1 7/2001 Falzon
6,286,900 B1 * 9/2001 Roark ..... 297/300.8
6,286,901 B1 9/2001 Ritch et al.
6,296,309 B1 * 10/2001 Kurtz ..... 297/297
6,318,800 B1 11/2001 DeKraker
6,367,876 B2 * 4/2002 Caruso et al. ..... 297/300.2
6,367,877 B1 * 4/2002 Knoblock et al. ..... 297/301.1
6,394,545 B2 * 5/2002 Knoblock et al. ..... 297/284.4
6,394,546 B1 5/2002 Knoblock et al.
6,394,548 B1 5/2002 Battey et al.
6,394,549 B1 5/2002 DeKraker et al.
6,474,737 B1 11/2002 Canteleux et al.
6,511,128 B2 * 1/2003 Piretti ..... 297/300.4
6,513,874 B1 2/2003 Sander et al.
6,523,898 B1 2/2003 Ball et al.
6,565,153 B2 5/2003 Hensel et al.
6,568,760 B2 * 5/2003 Davis et al. ..... 297/440.14
6,572,190 B2 6/2003 Koepke et al.
D476,821 S 7/2003 Koepke et al.
6,588,842 B2 7/2003 Stumpf et al.
6,609,755 B2 8/2003 Koepke et al.
6,616,231 B2 9/2003 Koepke et al.
6,626,497 B2 * 9/2003 Nagamitsu et al. ..... 297/452.15
6,644,741 B2 11/2003 Nelson et al.
6,669,292 B2 * 12/2003 Koepke et al. ..... 297/300.2
6,688,692 B2 2/2004 Phillips et al.
6,709,057 B2 3/2004 Sander et al.
6,709,058 B1 3/2004 Diffrient
6,709,060 B1 3/2004 Su
6,722,741 B2 4/2004 Stumpf et al.
6,729,691 B2 5/2004 Koepke et al.
6,739,664 B2 * 5/2004 Kinoshita et al. ..... 297/300.3
6,742,839 B2 6/2004 Piretti
6,749,261 B2 6/2004 Peterson et al.
6,761,406 B2 7/2004 Kinoshita et al.
D493,627 S 8/2004 Ma
6,802,566 B2 10/2004 Prince et al.
6,817,667 B2 11/2004 Pennington et al.
D499,260 S 12/2004 Glass et al.
6,840,582 B2 1/2005 Burwell et al.
6,843,530 B1 1/2005 Wu
6,863,346 B2 3/2005 Zund
D503,559 S 4/2005 Glass et al.
6,874,852 B2 4/2005 Footitt
6,896,329 B2 5/2005 Sander et al.
6,905,171 B2 6/2005 Dammermann et al.
6,908,159 B2 6/2005 Prince et al.
6,913,316 B2 * 7/2005 Kinoshita et al. ..... 297/300.3
6,935,689 B2 8/2005 Horiki et al.
6,945,602 B2 9/2005 Fookes et al.
6,957,861 B1 10/2005 Chou et al.
6,959,965 B2 11/2005 Diffrient
6,966,604 B2 11/2005 Stumpf et al.
D513,911 S 1/2006 Glass et al.
6,981,743 B2 1/2006 Edwards et al.
6,986,549 B2 1/2006 Kniese
6,991,291 B2 1/2006 Dammermann et al.
6,994,400 B2 2/2006 Koepke et al.
7,014,269 B2 3/2006 Coffield et al.
7,040,709 B2 5/2006 Dammermann et al.
D522,265 S 6/2006 Glass et al.
7,063,384 B2 6/2006 Liu
7,066,537 B2 6/2006 Coffield et al.
7,066,538 B2 * 6/2006 Machael et al. ..... 297/300.2
7,104,604 B1 9/2006 Kang
7,114,777 B2 10/2006 Knoblock et al.
7,131,700 B2 11/2006 Dammermann et al.
7,134,722 B2 * 11/2006 Ueda et al. ..... 297/301.1
7,147,286 B2 12/2006 Cesaroni et al.
D541,063 S 4/2007 Su
7,213,880 B2 5/2007 Schmitz et al.
7,213,886 B2 5/2007 Schmitz et al.
D544,230 S 6/2007 Glass et al.
7,234,772 B2 6/2007 Wells
7,249,802 B2 7/2007 Schmitz et al.
7,273,253 B2 9/2007 Deimen et al.
7,281,764 B2 10/2007 Thole
7,296,853 B2 11/2007 Piretti
D558,995 S 1/2008 Igarashi
D559,571 S 1/2008 Meda
D559,572 S 1/2008 Igarashi
7,347,495 B2 3/2008 Beyer et al.
D566,979 S 4/2008 Cox et al.
7,360,835 B2 4/2008 Tubergen et al.
D572,948 S 7/2008 Wakasugi et al.
7,419,222 B2 9/2008 Schmitz et al.
7,422,287 B2 9/2008 Heidmann et al.
7,425,037 B2 9/2008 Schmitz et al.
7,441,839 B2 10/2008 Pennington et al.
D582,170 S 12/2008 Chi
7,484,802 B2 2/2009 Beyer et al.
7,517,024 B2 4/2009 Cvek
D597,758 S 8/2009 Barrett et al.
D600,462 S 9/2009 Ooki et al.
7,600,814 B2 * 10/2009 Link ..... 297/300.2
7,600,820 B2 10/2009 Bouche et al.
7,665,805 B2 * 2/2010 Ueda ..... 297/301.6
7,712,833 B2 * 5/2010 Ueda ..... 297/296
7,717,511 B2 5/2010 Huang
7,717,513 B2 * 5/2010 Ueda ..... 297/300.2
D618,469 S 6/2010 Romero
7,726,740 B2 * 6/2010 Masunaga ..... 297/303.3
7,794,016 B1 9/2010 Lucci et al.
7,798,573 B2 9/2010 Pennington et al.
7,837,265 B2 11/2010 Machael et al.

(56) References Cited

U.S. PATENT DOCUMENTS

| | | | | |
|---|---|---|---|---|
| 7,841,666 | B2 | 11/2010 | Schmitz et al. | |
| 7,850,241 | B1 | 12/2010 | Lucci et al. | |
| 7,878,591 | B2 | 2/2011 | Walker et al. | |
| D639,576 | S | 6/2011 | Breen | |
| 7,971,936 | B2 * | 7/2011 | Fukai | 297/320 |
| D643,641 | S | 8/2011 | Figueroa | |
| D643,642 | S | 8/2011 | Figueroa | |
| 7,992,937 | B2 * | 8/2011 | Plikat et al. | 297/300.2 |
| 7,997,652 | B2 * | 8/2011 | Roslund et al. | 297/300.2 |
| D646,092 | S | 10/2011 | Romero | |
| 8,029,060 | B2 * | 10/2011 | Parker et al. | 297/300.1 |
| D648,561 | S | 11/2011 | Johansson | |
| D648,564 | S | 11/2011 | Johansson | |
| 8,061,775 | B2 | 11/2011 | Diffrient | |
| D649,795 | S | 12/2011 | Izawa | |
| 8,075,058 | B2 | 12/2011 | Baumann | |
| D652,223 | S | 1/2012 | Fujita | |
| 8,210,611 | B2 | 7/2012 | Aldrich et al. | |
| 8,215,710 | B2 | 7/2012 | Erker | |
| 8,251,448 | B2 | 8/2012 | Machael et al. | |
| 8,262,162 | B2 | 9/2012 | Castro et al. | |
| 8,297,701 | B2 | 10/2012 | Machael et al. | |
| D671,759 | S | 12/2012 | Hurford | |
| D676,254 | S | 2/2013 | Chen | |
| 8,414,073 | B2 * | 4/2013 | Schmitz et al. | 297/321 |
| D683,558 | S | 6/2013 | Rada et al. | |
| 8,480,171 | B2 | 7/2013 | Chadwick et al. | |
| D688,483 | S | 8/2013 | Aratani | |
| 8,544,951 | B2 | 10/2013 | Machael et al. | |
| 8,550,557 | B2 * | 10/2013 | Bock | 297/320 |
| 8,616,640 | B2 | 12/2013 | van Hekken | |
| D696,886 | S | 1/2014 | Nakamura | |
| D701,068 | S | 3/2014 | Usumoto et al. | |
| 8,663,514 | B2 | 3/2014 | Deskevich et al. | |
| D704,944 | S | 5/2014 | Koepke et al. | |
| D707,460 | S | 6/2014 | Giugiaro | |
| D707,461 | S | 6/2014 | Rada et al. | |
| D714,070 | S | 9/2014 | Cvek | |
| D715,068 | S | 10/2014 | Chan | |
| D718,544 | S | 12/2014 | Lu | |
| D731,833 | S | 6/2015 | Fifield et al. | |
| 2002/0043843 | A1 | 4/2002 | Pennington et al. | |
| 2002/0190552 | A1 * | 12/2002 | Koepke et al. | 297/284.7 |
| 2002/0190553 | A1 * | 12/2002 | Koepke et al. | 297/300.2 |
| 2002/0190564 | A1 * | 12/2002 | Coffield et al. | 297/452.56 |
| 2003/0001425 | A1 * | 1/2003 | Koepke et al. | 297/452.56 |
| 2003/0075961 | A1 * | 4/2003 | Struppler et al. | 297/300.5 |
| 2003/0107252 | A1 * | 6/2003 | Kinoshita et al. | 297/301.1 |
| 2003/0127896 | A1 | 7/2003 | Deimen et al. | |
| 2003/0137173 | A1 | 7/2003 | Kinoshita et al. | |
| 2004/0017102 | A1 | 1/2004 | Igarashi et al. | |
| 2005/0062323 | A1 | 3/2005 | Dicks | |
| 2005/0093354 | A1 * | 5/2005 | Ball et al. | 297/284.4 |
| 2005/0121954 | A1 * | 6/2005 | Coffield et al. | 297/218.3 |
| 2005/0231013 | A1 * | 10/2005 | Knoblock et al. | 297/284.4 |
| 2005/0269848 | A1 * | 12/2005 | Harley | 297/230.1 |
| 2006/0001303 | A1 | 1/2006 | Raftery et al. | |
| 2006/0006715 | A1 | 1/2006 | Chadwick et al. | |
| 2006/0033369 | A1 | 2/2006 | Eysing | |
| 2006/0103208 | A1 | 5/2006 | Schmitz et al. | |
| 2006/0181126 | A1 | 8/2006 | Eysing | |
| 2007/0057549 | A1 | 3/2007 | Ball et al. | |
| 2007/0108818 | A1 * | 5/2007 | Ueda et al. | 297/285 |
| 2007/0108819 | A1 | 5/2007 | Ueda | |
| 2007/0108820 | A1 | 5/2007 | Ueda et al. | |
| 2007/0108821 | A1 * | 5/2007 | Ueda | 297/301.1 |
| 2007/0216208 | A1 | 9/2007 | Maier et al. | |
| 2007/0222266 | A1 | 9/2007 | Lucci et al. | |
| 2007/0284920 | A1 | 12/2007 | Mehaffey et al. | |
| 2008/0272636 | A1 | 11/2008 | Machael et al. | |
| 2008/0315645 | A1 | 12/2008 | Hock | |
| 2009/0195047 | A1 | 8/2009 | Bouche et al. | |
| 2009/0273126 | A1 | 11/2009 | Scott | |
| 2010/0078975 | A1 | 4/2010 | Kang | |
| 2010/0187891 | A1 | 7/2010 | O'Connor et al. | |
| 2010/0194160 | A1 | 8/2010 | Machael et al. | |
| 2010/0283308 | A1 | 11/2010 | Deskevich et al. | |
| 2010/0295351 | A1 * | 11/2010 | Bock | 297/322 |
| 2011/0074197 | A1 | 3/2011 | Okamoto | |
| 2011/0074201 | A1 | 3/2011 | Parker et al. | |
| 2011/0193384 | A1 | 8/2011 | Ni | |
| 2011/0198909 | A1 * | 8/2011 | Fifield | 297/452.56 |
| 2011/0233979 | A1 * | 9/2011 | An | 297/284.4 |
| 2011/0285190 | A1 | 11/2011 | Wu | |
| 2011/0285191 | A1 | 11/2011 | van Hekken | |
| 2012/0007400 | A1 * | 1/2012 | Behar et al. | 297/284.4 |
| 2012/0025574 | A1 | 2/2012 | Wilkinson et al. | |
| 2012/0242130 | A1 | 9/2012 | Hung | |
| 2013/0169014 | A1 | 7/2013 | Machael et al. | |
| 2014/0077542 | A1 * | 3/2014 | Vander Veen | A47C 1/032 297/228.11 |
| 2014/0191546 | A1 | 7/2014 | Machael et al. | |
| 2014/0265493 | A1 | 9/2014 | Machael et al. | |
| 2015/0296989 | A1 | 10/2015 | Machael et al. | |

FOREIGN PATENT DOCUMENTS

| | | | | |
|---|---|---|---|---|
| CN | 201064296 | Y | 5/2008 | |
| CN | ZL2014303935083 | S | 6/2015 | |
| DE | 3640336 | A1 | 8/1987 | |
| DE | 4135603 | A1 | 5/1992 | |
| DE | 29507658 | U1 | 2/1996 | |
| DE | 4437394 | A1 | 4/1996 | |
| DE | 29711329 | U1 | 10/1997 | |
| DE | 10318759 | B3 | 7/2004 | |
| DE | 202008016260 | U1 | 4/2009 | |
| EP | 0574375 | A1 | 12/1993 | |
| EP | 0688522 | A1 | 12/1995 | |
| EP | 0970639 | A1 | 1/2000 | |
| EP | 1232703 | B1 | 8/2002 | |
| EP | 1768516 | B1 | 4/2007 | |
| EP | 2110051 | A1 | 10/2009 | |
| EP | 2622991 | A1 | 8/2013 | |
| JP | 2004049658 | A | 2/2004 | |
| JP | 2004049691 | A | 2/2004 | |
| JP | 2004298434 | A | 10/2004 | |
| KR | 2003059582 | * | 7/2003 | A47C 7/44 |
| MX | 2008012133 | A | 11/2008 | |
| OM | ID201400020 | S | 6/2015 | |
| WO | WO 9220262 | A1 * | 11/1992 | A47C 1/032 |
| WO | WO03068025 | A2 | 8/2003 | |
| WO | WO2004008915 | A1 | 1/2004 | |
| WO | 2007112236 | A1 | 10/2007 | |
| WO | WO 02102197 | * | 12/2007 | |
| WO | WO2013020088 | A2 | 2/2013 | |
| WO | 2014144143 | A1 | 9/2014 | |

OTHER PUBLICATIONS

"Contessa Task" by Teknion, copyright 2003-2004, downloaded from http://www.teknion.com/products/seating, 2 pages.

"Contessa: Ergonomic Concept", Okamura Today, copyright 2000-2004 Okamura Corporation, downloaded from http://www.okamura.co.jp/english/product/office/contessa/concept/index.html, 2 pages.

International Search Report and Written Opinion issued in PCT/US2007/064413, mailed Auust 16, 2007, 11 pages.

International Search Report and Written Opinion issued in PCT/US2014/028431, mailed Jul. 7, 2014, 9 pages.

"Moroso racconta:—Supernatural", 2005, Ross Lovegrove Design, retrieved from http://www.moroso.it/famiglia/supernatural/?lang=en Jan. 14, 2015, 13 pages.

"Alumni Classroom Furniture Brochure", retrieved from http://www.alumnicf.com/ALUMNI_BROCHURE.pdf Jan. 14, 2015, 64 pages.

"Bernhardt Design, Orbit Ross Lovegrove Brochure", retrieved http://bernhardtdesign.com/pdf/brochures/0031/orbit.pdf from Jan. 14, 2015, 3 pages.

Columbia Medical-Omni™ /Omniverse™ Transfer Systems and Rolling Chair Brochure, Brochure—retrieved from http://www.columbiamedical.com/docs/Omni-OV-order-form-web.pdf Jan. 14, 2015, 2 pages.

(56) References Cited

OTHER PUBLICATIONS

"Flototto Pro, Uber Pro", retrieved from http://www.floetotto.de/pro/index.html Jan. 14, 2015, 9 pages.
"Jasper Morrison: Air Chair Brochure", retrieved from http://www-wjaspermorrison.com/html/17226891.html Jan. 14, 2015, 1 page.
"Mario Bellini Architects Design, Ultrabellini Chair Brochure", retrieved from http://bellini.it/design/heller_ultrachair.html Jan. 14, 2015, 1 page.
"Smith System—Furniture for Inspired Learning 2014 Catalog", retrieved from http://smithsystem.wpengine.netdna-cdn.com/wp-content/uploads/2014/01/SmithSystem_2014Catalog.pdf Jan. 14, 2015, 129 pages.
"Spaceist Office Furniture", Colorful Stacking Café Chairs, retrieved from http://www.spaceist.co.uk/cafe-bar-furniture/cafe-furniture/cafe-chairs/colourful-cafe-chairs Jan. 14, 2015, 5 pages.
International Preliminary Report on Patentability issued in PCT/US2014/028431, mailed Sep. 24, 2015, 6 pages.
International Search Report and Written Opinion issued in PCT/US2010/022890, mailed Jul. 13, 2010, 14 pages.
International Search Report and Written Opinion issued in PCT/US2015/025546, mailed Aug. 14, 2015, 10 pages.
Seating Solutions Brochure-Ergonomics and Comfort in the 21st Century Learning Enviroment-Vanerum Stelter, retrieved from http://www.vanerumstelter.com/ Jan. 14, 2015, 20 pages.

* cited by examiner

DYNAMIC CHAIR BACK LUMBAR SUPPORT SYSTEM

CROSS-REFERENCE TO RELATED APPLICATIONS

This application is a continuation of U.S. patent application Ser. No. 12/048,113, filed on Mar. 13, 2008, and entitled, "Dynamic Chair Back Lumbar Support System," which claims the benefit of U.S. Provisional Patent Application Ser. No. 60/894,659, filed on Mar. 13, 2007, and entitled, "Dynamic Chair Back Lumbar Support System," both of which are incorporated by reference herein in their entireties.

TECHNICAL FIELD

Embodiments of the present invention relate generally to office furniture, and more specifically to a dynamic chair back lumbar support system therefor.

BACKGROUND

Current reclining chair designs often do not effectively match movement of a user with movement of the chair parts. For example, some chairs feature a reclining seat back coupled with a stationary seat, which does not permit the user's spine to conform to a natural position when reclining. As a user shifts a chair from an upright to a reclined position, a user's spine undergoes increased curvature, particularly in the lumbar region, which is often not addressed by chair backs which maintain the same shape throughout reclination. Therefore, there is a need in the art for an improved chair back design.

SUMMARY

A chair back according to some embodiments of the present invention includes a flexible frame portion configured for attachment to a seat and a rigid support member configured for pivotal attachment to a chair base, wherein a degree of curvature of the flexible frame portion increases dynamically as the rigid support member reclines about the chair base.

A chair back according to other embodiments of the present invention includes a rigid support member configured for reclinable attachment to a chair base, a flexible frame member including a flexible frame and a mesh element, the mesh element at least partially spanning the flexible frame, and at least one seat attachment member configured for coupling to a seat, the seat moving in synchronization with the rigid support member at a different rate than the rigid support member during reclining of the rigid support member. According to such embodiments, a first portion of the flexible frame member is affixed to the rigid support member, and a second portion of the flexible frame member flexes freely with respect to the rigid support member, such that the at least one seat attachment member contacts at least part of the second portion of the flexible frame member, and the first portion moves with the rigid support member and the at least part of the second portion moves with the seat attachment member such that a degree of curvature of the second portion increases as the rigid support member reclines. In some cases, the flexible frame is an inverted U-shaped frame. The seat attachment member may be rotatably or rigidly coupled with the flexible frame member; alternatively, the seat attachment member may be formed integrally with the flexible frame member or the seat. The flexible frame may be an outer frame, and the mesh element may be configured to contact a user's back. The free-flexing portion of the flexible frame member may be configured to provide support to a lumbar region of a user's back, and may be configured to dynamically adjust to match increasing curvature of a user's lumbar back region during reclining. A mesh element may be configured to at least partially span the flexible frame portion, and to contact a user's back. In some cases, the flexible frame portion is configured for attachment to the seat via a seat attachment member, and is configured to dynamically adjust to match increasing curvature of a user's lumbar back region during reclining.

A chair according to some embodiments of the present invention includes a base, a seat pivotably coupled to the base, a back including a rigid support member and a flexible frame member, the rigid support member pivotably coupled to the base, the flexible frame member coupled to the rigid support member and coupled to the seat, and a linkage assembly coupled to the back and to the seat, the linkage assembly configured to rotate the seat at least partially upwardly and at least partially toward the back during reclining of the back about the base, wherein a curvature of the flexible frame member increases as the back reclines about the base. The flexible frame member may be coupled to the seat by a seat attachment member, which may be a spring. The flexible frame member may be pivotably or rigidly coupled to the seat, and a mesh or polymer element may at least partially span the flexible frame member to contact a user's back, for example.

A chair back according to embodiments of the present invention includes a rigid support member configured for reclinable attachment to a chair base, a flexible frame member comprising a flexible frame and a mesh element, the mesh element at least partially spanning the flexible frame, and at least one seat attachment member coupled to a seat, the seat having a substantially fixed position with respect to the chair base, wherein a first portion of the flexible frame member is affixed to the rigid support member, wherein a second portion of the flexible frame member flexes freely with respect to the rigid support member, wherein the at least one seat attachment member contacts at least part of the second portion of the flexible frame member, and wherein the first portion moves with the rigid support member such that a degree of curvature of the second portion increases as the rigid support member reclines. In some cases, the seat attachment member is a spring. The flexible frame member may be pivotably or rigidly coupled with the seat attachment member, which may itself be a part of a core assembly or control assembly, according to embodiments of the present invention. A mesh and/or polymer element may at least partially span the flexible frame member.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
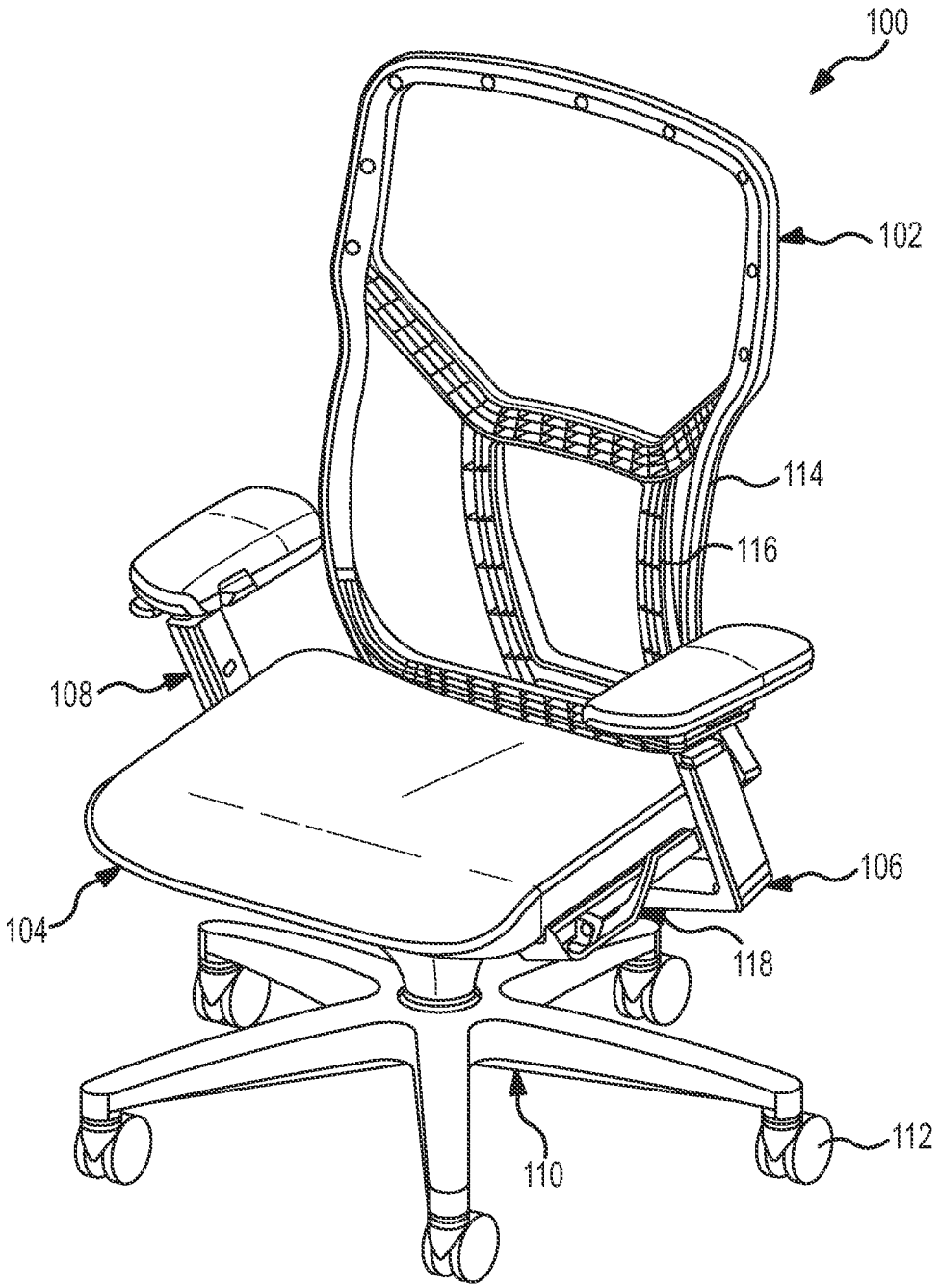
FIG. 1 illustrates a front perspective view of a chair according to embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Embodiments of the present invention relate generally to office furniture, and more specifically to a chair back which changes shape during reclination. FIGS. 1-7 depict a reclining office chair 100 according to embodiments of the present invention. Chair 100 includes a back 102, a seat 104, a left arm 106, a right arm 108, and a base pedestal 110. Seat 104 and back 102 of chair 100 rotate about base pedestal 110, and casters 112 or wheels may be coupled to base pedestal 110 to contact an underlying surface (such as, for example, a floor), according to embodiments of the present invention. Back 102 may include a support member 116 and a covering (not shown) made of mesh, fabric, polymer, plastic, or the like which is coupled to back 102 along outer frame 114 and against which a user's back would rest, according to embodiments of the present invention.

As used herein, the term "coupled" is used in its broadest sense to refer to elements which are connected, attached, and/or engaged, either directly or integrally or indirectly via other elements, and either permanently, temporarily, or removably. As used herein, the term "swivelably coupled" is used in its broadest sense to refer to elements which are coupled in a way that permits one element to swivel with respect to another element. As used herein, the terms "rotatably coupled" and "pivotably coupled" are used in their broadest sense to refer to elements which are coupled in a way that permits one element to rotate or pivot with respect to another element. As used herein, the term "slidably coupled" is used in its broadest sense to refer to elements which are coupled in a way that permits one element to slide or translate with respect to another element.

Figure 2:
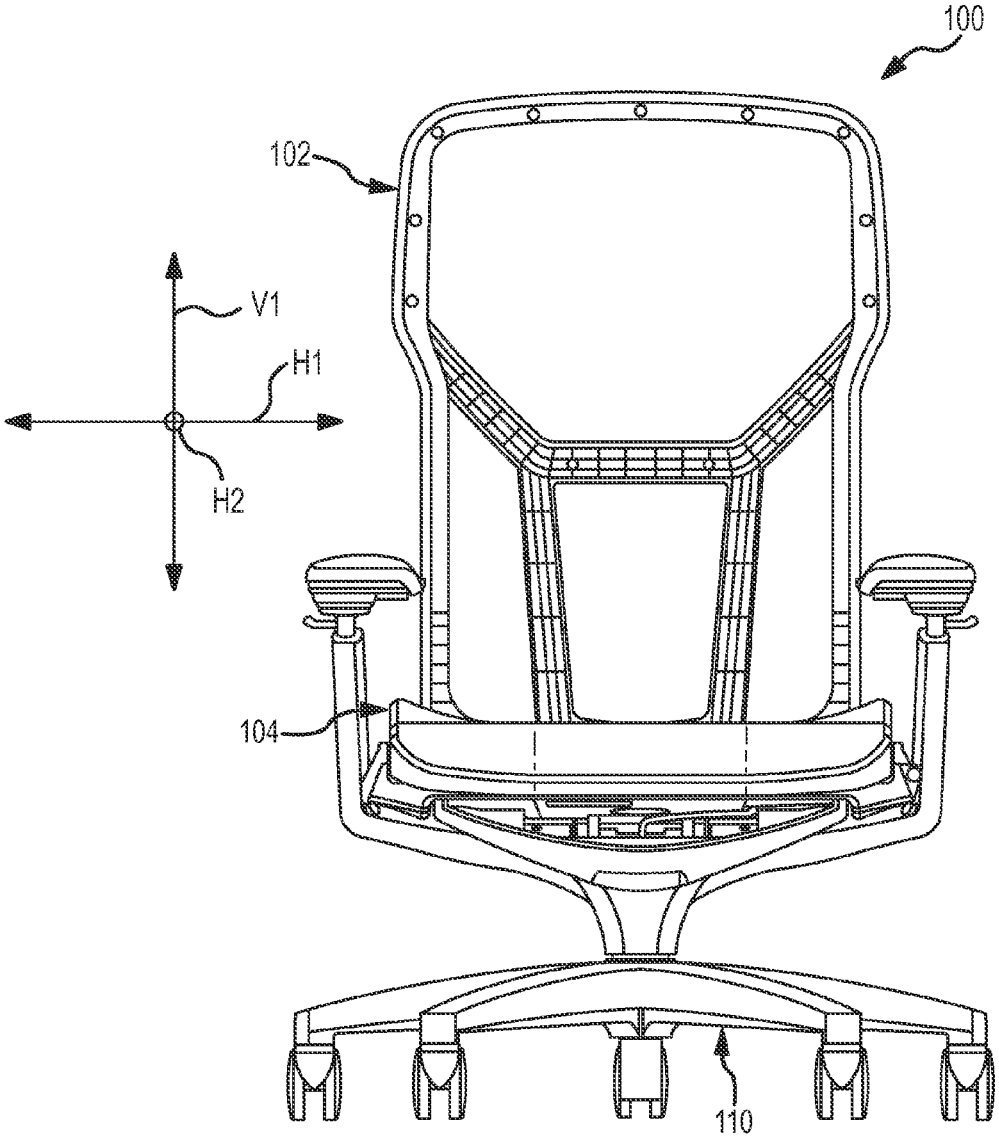
FIG. 2 illustrates a front view of the chair of FIG. 1, according to embodiments of the present invention.
Figure 3:
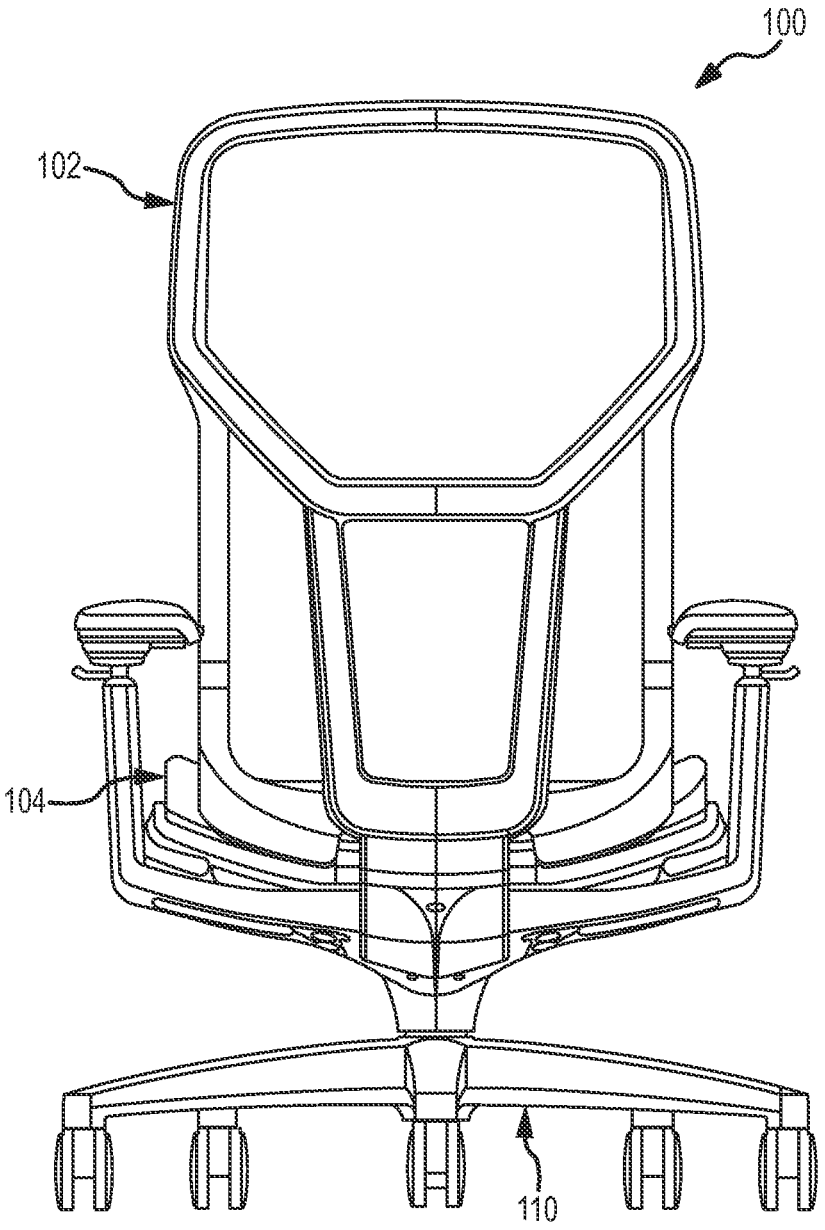
FIG. 3 illustrates a back view of the chair of FIGS. 1 and 2, according to embodiments of the present invention.
Figure 4:
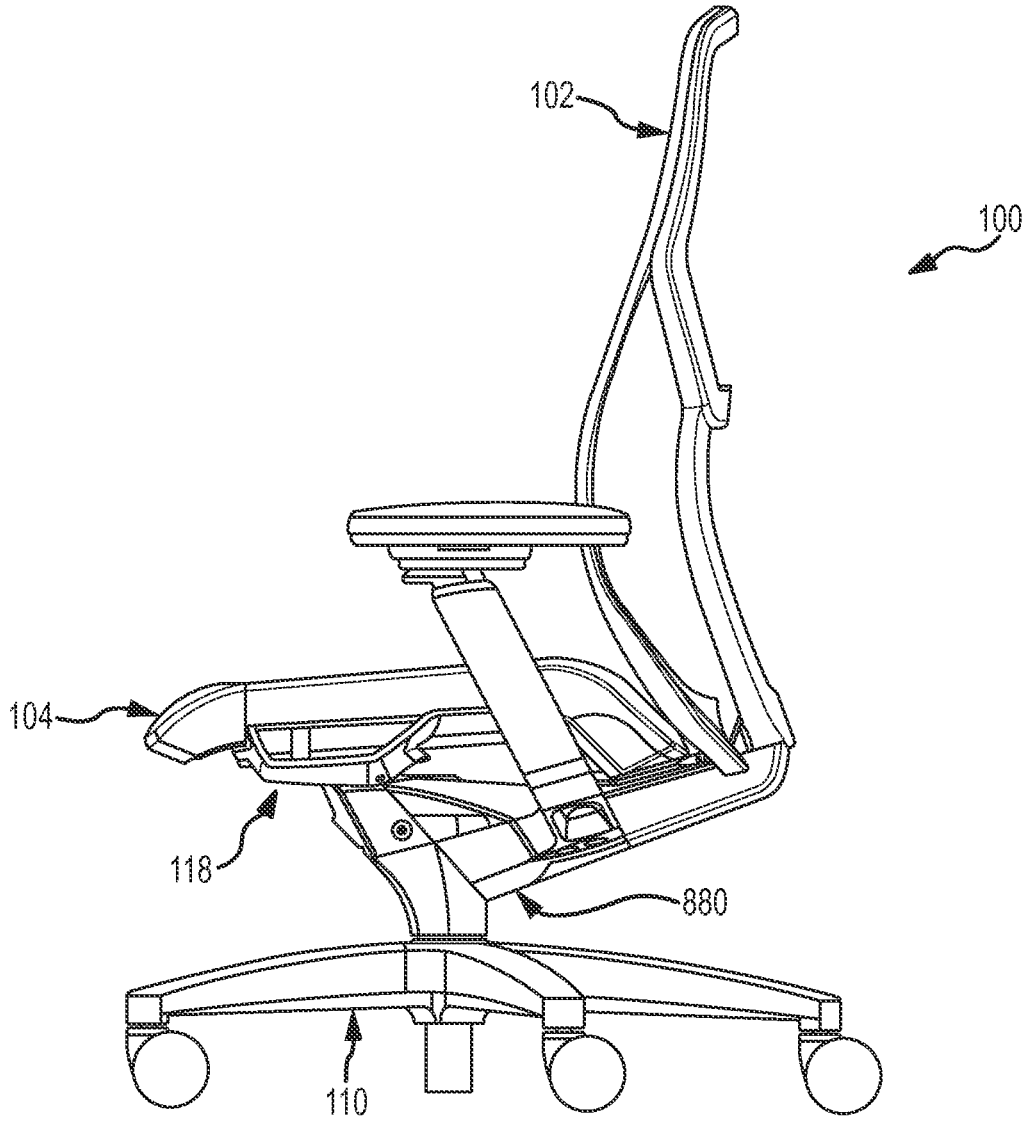
FIG. 4 illustrates a side view of the chair of FIGS. 1-3, according to embodiments of the present invention.
Figure 5:
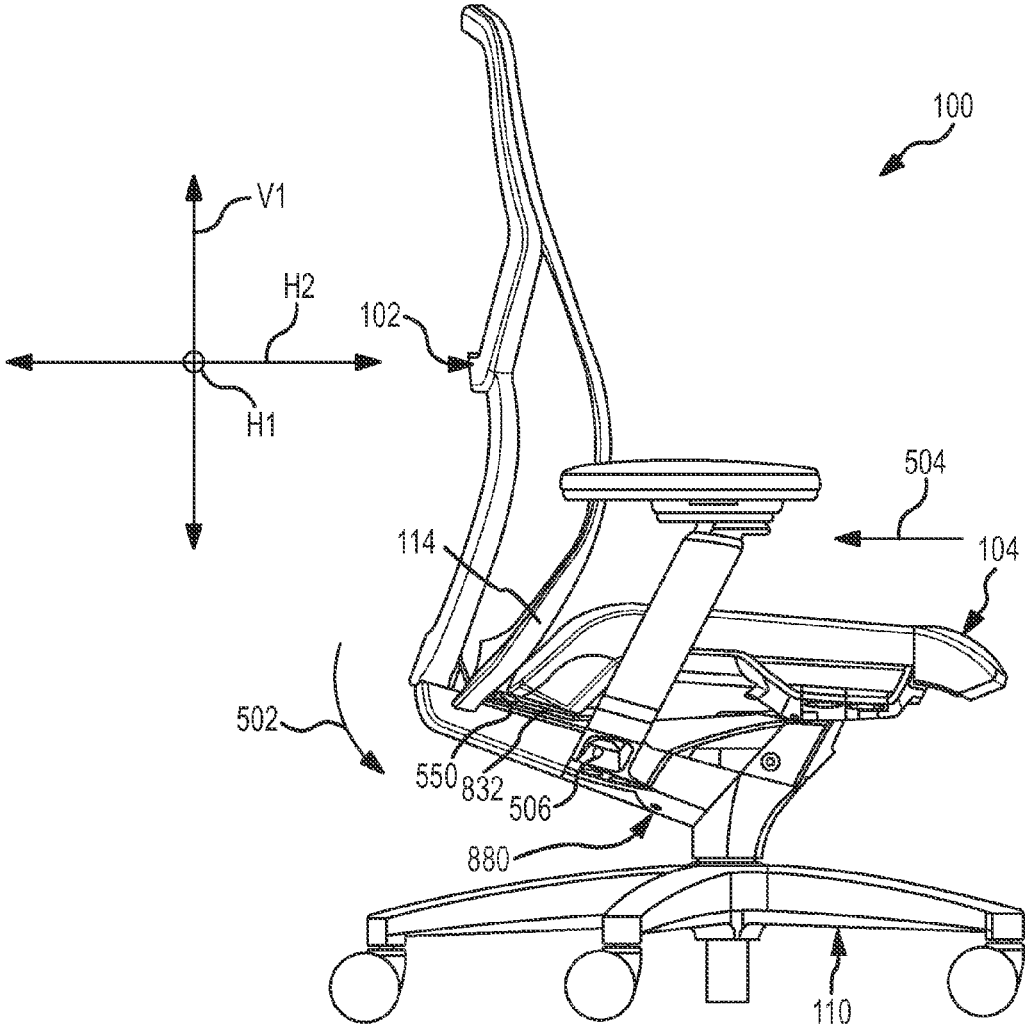
FIG. 5 illustrates another side view of the chair of FIGS. 1-4, according to embodiments of the present invention.
Figure 6:
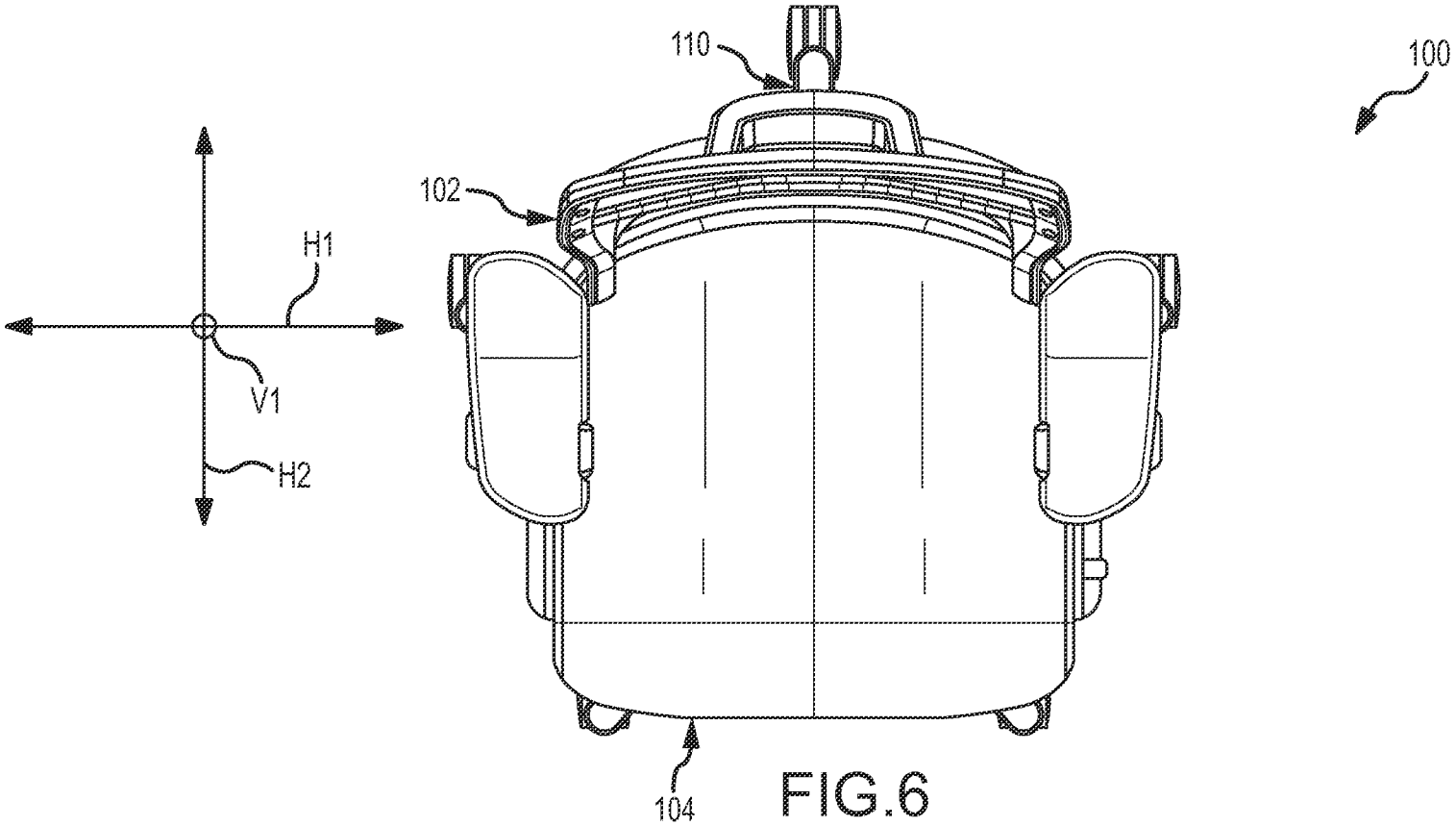
FIG. 6 illustrates a top view of the chair of FIGS. 1-5, according to embodiments of the present invention.
Figure 7:
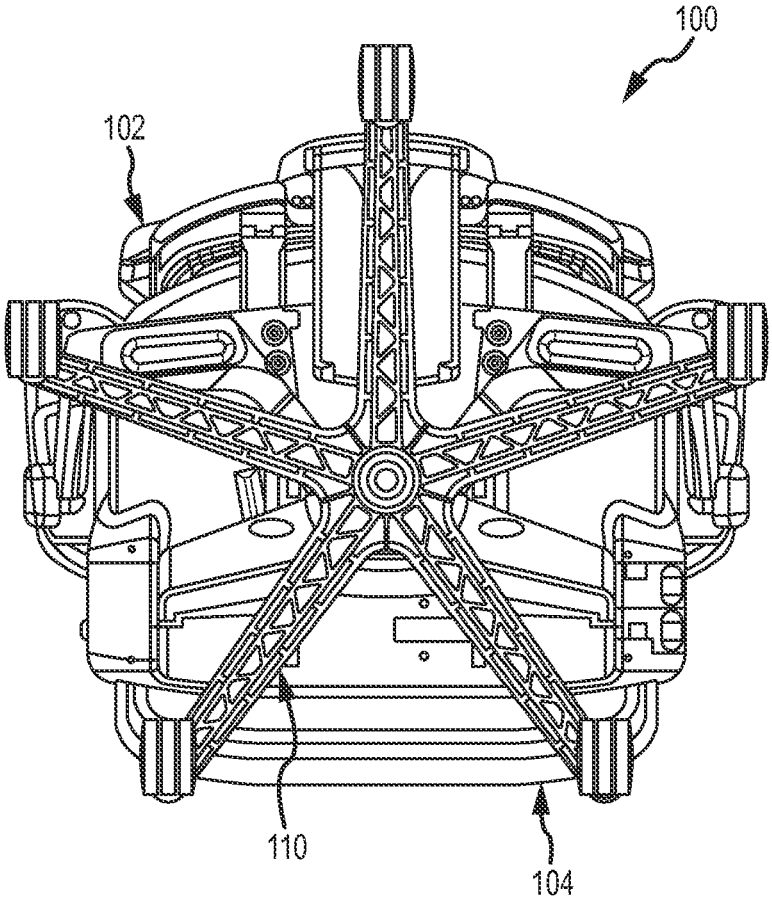
FIG. 7 illustrates a bottom view of the chair of FIGS. 1-6, according to embodiments of the present invention.

As used herein, the terms "horizontal," "horizontally," and the like are used in their broadest sense to refer to a direction along or parallel to a plane relative to a chair 100, where such plane is defined by the lines H1 and H2 depicted in FIGS. 2, 5 and 6. Although lines H1 and H2 are not shown in all views, the plane defined by H1 and H2 in FIGS. 2, 5 and 6 serves to define such plane in all views as such plane is defined relative to chair 100. As used herein, the terms "vertical," "vertically," and the like are used in their broadest sense to refer to a direction along or parallel to a line relative to a chair 100, where such line is defined by the line V1 of FIGS. 2, 5 and 6. Although line V1 is not shown in all views, line V1 serves to define such line in all views as such line is defined relative to chair 100.

As illustrated in the side view of FIG. 5 (and also shown in FIG. 9), back 102 reclines and/or rotates in a direction generally indicated by arrow 502 about a pivot point generally indicated at 506, when user pushes against back 102. This rotation of back 102 in direction 502 causes seat 104 to slide generally towards the back 102 in a direction indicated by arrow 504, as well as generally upwardly. According to embodiments of the present invention, the seat 104 does not move at the same rate as the back 102 during reclination; in other words, the back 102 and seat 104 do not form a simple "L" shape which simply tilts backwardly during reclination.

Figure 8:
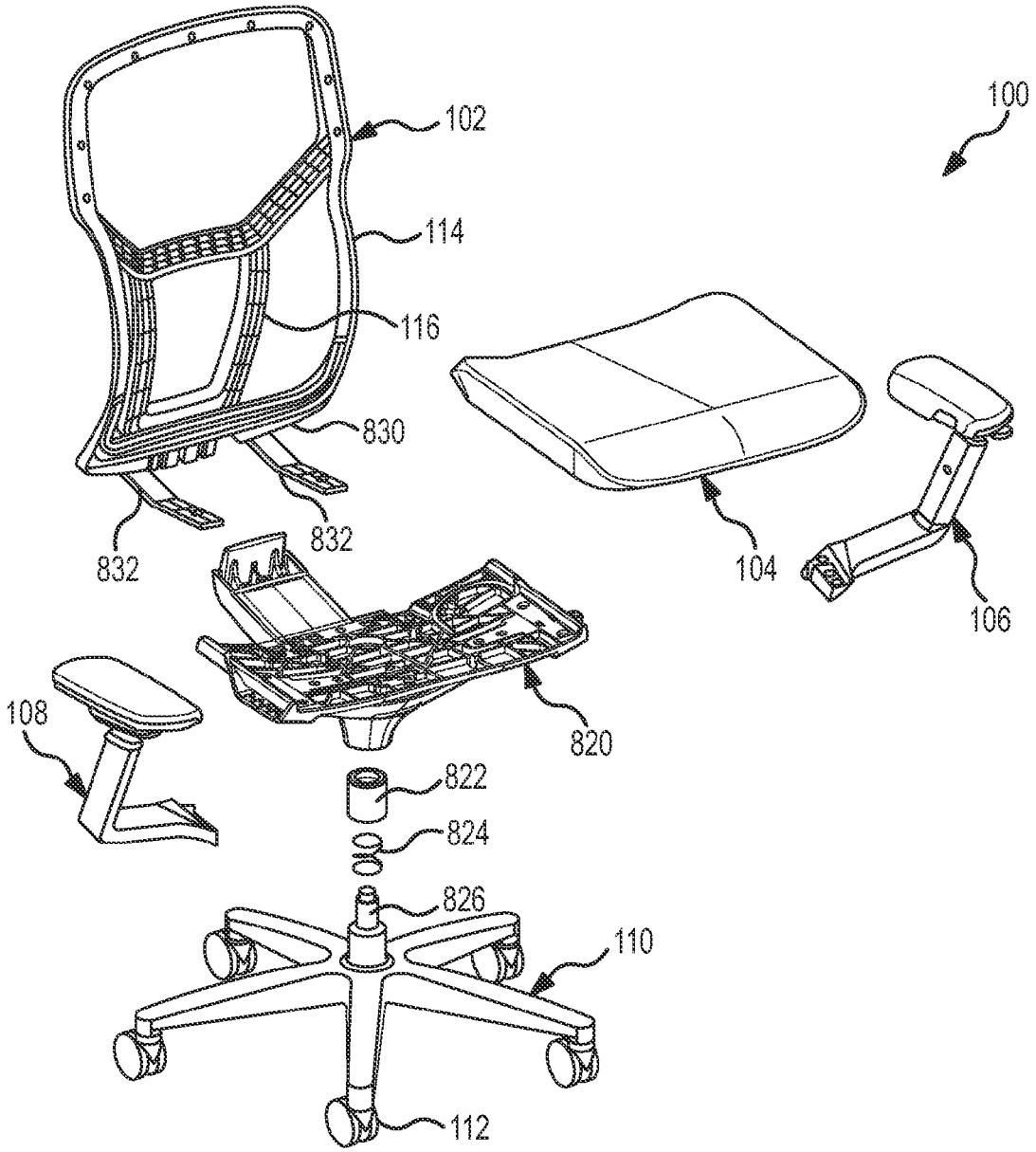
FIG. 8 illustrates an exploded perspective view of the chair of FIGS. 1-7, according to embodiments of the present invention.

FIG. 8 depicts an exploded view of chair 100 including back 102, seat 104, left arm 106, right arm 108, pedestal 110, casters 112, and core assembly 820, which are coupled to form chair 100. Core assembly 820 is coupled with pedestal 110 via a hydraulic piston 826 which permits core assembly 820 to rotate about pedestal 110 and which permits the height of core assembly 820 to be adjusted with respect to pedestal 110. Sheath 822 may be included between core assembly 820 and pedestal 110 to cover and protect hydraulic piston 826 and/or spring 824. Spring 824 may be included between core assembly 820 and pedestal 110 in order to supply an upwardly-biased force to raise sheath 822 as core assembly 820 is lifted by hydraulic piston 826, according to embodiments of the present invention. As used herein, the terms "base" and "chair base" are used in their broadest sense to refer to an element or elements about which the back 102 reclines. According to some embodiments of the present invention, the base of chair 100 may be a component of core assembly 820 about which the other components and/or linkages (such as a linkage 880 shown in FIGS. 4, 5, and 9) move or rotate; for example, the base may be the element of core assembly 820 which interfaces directly with the piston 826 and the other elements which are rigidly coupled to such element. In other words, the base of chair 100 may be, in kinematic terms, the "ground link 880A" near the seat 104 to which the other links 880B, 880C are coupled, according to embodiments of the present invention. In the embodiments shown in FIGS. 4, 5, and 9, the chair 100 includes the linkage assembly 880 coupled to the back 102 and to the seat 104, the linkage assembly 880 configured to rotate the seat 104 at least partially upwardly and at least partially toward the back 102 during reclining of the back 102 about the base 110.

Figure 9:
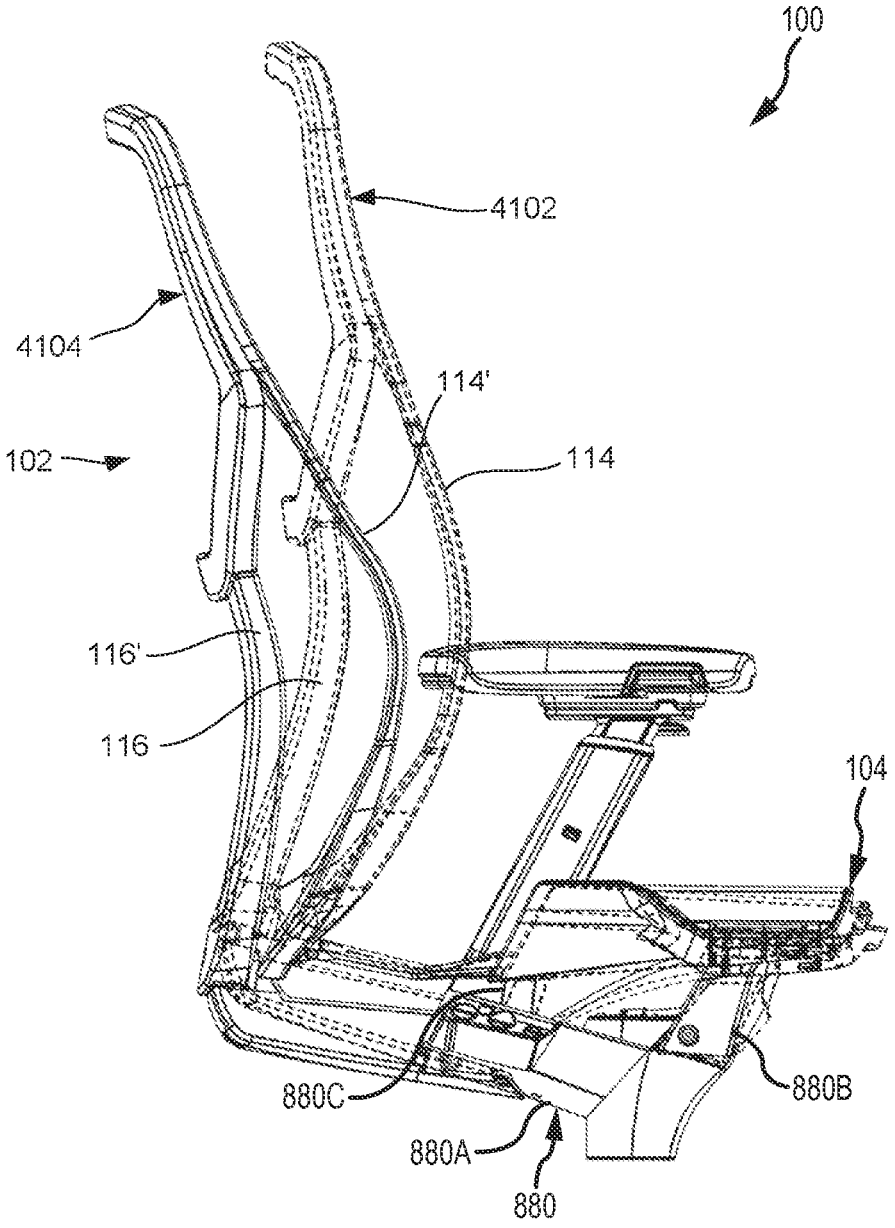
FIG. 9 illustrates a side view of the chair of FIGS. 1-8 with an upright position in broken lines superimposed upon a reclined position in solid lines, according to embodiments of the present invention.

FIG. 9 illustrates a chair back 102 in an upright position 4102 in dotted lines superimposed upon a chair back 102 in a reclined position 4104 in solid lines. Generally, a user's back undergoes an increasing amount of curvature as a chair back 102 is progressed through an increasing degree of reclination, and/or the user's back requires greater support in the lumbar region as the chair back 102 is progressed through an increasing degree of reclination. Embodiments of the present invention seek to add to the user's comfort during reclining by more closely matching movement of chair back 102 to the movement and/or support requirements of a user's back, and by minimizing misalignment of the user's back with respect to back 102. In the embodiment shown in FIGS. 1-9, the seat 104 is pivotably coupled to the base 110 (shown in FIGS. 1-8).

As seen in FIG. 8, core assembly 820 includes one or more springs or seat attachment members 832 coupling the back of core assembly 820 to back 102. Such springs 832 may be rigid or semi-rigid springs, and may be coupled to a seat plate such that their movement follows any movement of the seat 104, according to embodiments of the present invention. The outer frame 114 may include one or more lower pads 830. According to some embodiments of the present invention, the seat 104 remains stationary as the back 102 reclines, thereby also creating a curvature of the frame 114 based on the relative motion of the back 102 with respect to the seat 104. According to some embodiments of the present invention, the frame 114 may be coupled directly or indirectly to a stationary seat 104 and/or to another element which does not move with respect to the back 102; for example, the frame 114 may be coupled to a portion of the core assembly 820 which, as the back 102 reclines, has a different relative motion in order to create an increasing curvature of the frame 114 as the back 102 reclines.

According to embodiments of the present invention, springs 832 are affixed to a seat plate of the core assembly 820 on one end, and are rotatably coupled to pads 830 at the other end. According to such embodiments, the lower end of outer frame 114 (e.g. pads 830) travels along with seat 104 during reclining, which causes the outer frame 114 to exhibit a greater degree of bending and/or curvature during reclining, particularly in chairs 100 in which the seat 104 moves at a different rate from the back 102 during reclining. FIG. 9 conceptually illustrates the different curvature of outer frame 114' upon reclining to position 4104 when outer frame 114' is rotatably coupled to support member 116 (e.g. via pads 830), according to embodiments of the present invention. According to such embodiments, outer frame 114' exhibits a curvature (e.g. in the lumbar region) which increases as the chair 100 is reclined, just as the curvature of a user's back increases as the user's back moves with the reclining back 102.

Although embodiments of the present invention illustrate the use of dual springs 832 rotatably coupled with dual pads 830, other embodiments of the present invention include a single spring 832 rotatably coupled with a single pad 830 and/or directly with the outer frame 114. Yet other embodiments include two or more springs 832 rotatably coupled with two or more pads 830, and/or a rotatable coupling directly between seat 104 and/or seat support members and outer frame 114. According to some embodiments of the present invention, a non-rotatable coupling may be used between outer frame 114 and spring 832, which still permits movement of outer frame 114 with seat 104 instead of with back 102.

Figure 10:
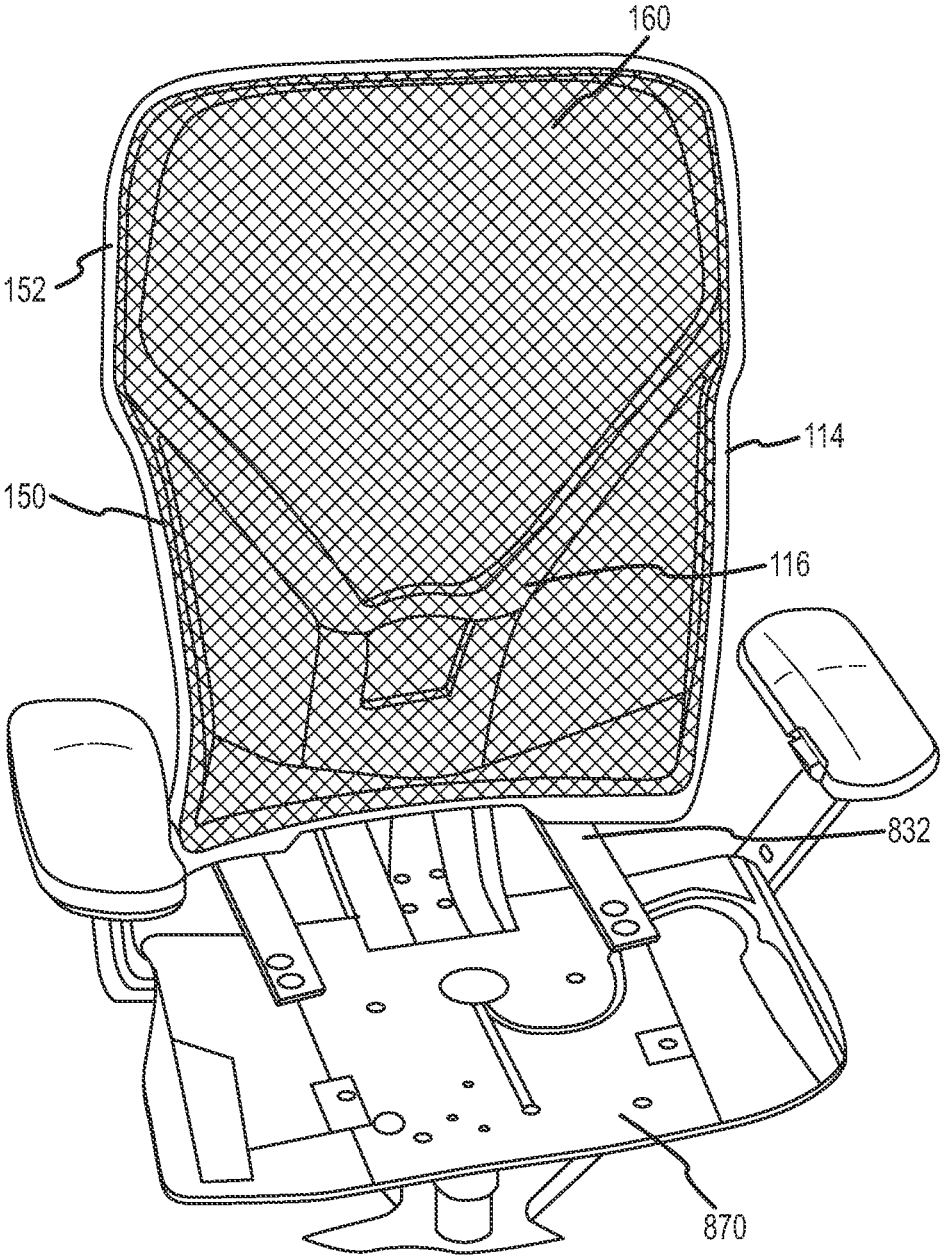
FIG. 10 illustrates a front perspective view of a chair and back according to embodiments of the present invention.
Figure 11:
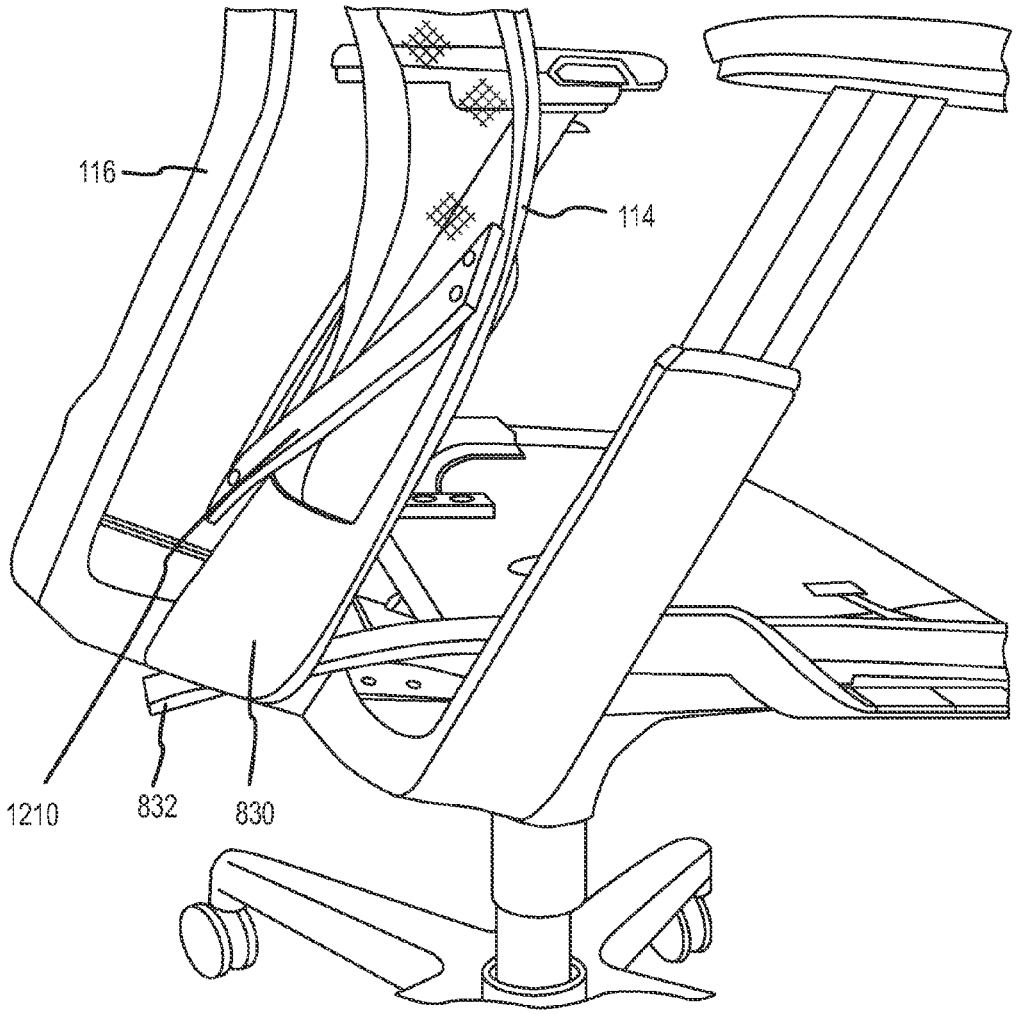
FIG. 11 illustrates a side view of a chair back whose shape changes dynamically throughout reclination, according to embodiments of the present invention.

FIG. 10 illustrates a front perspective view of a chair and back according to embodiments of the present invention. FIG. 11 illustrates a side view of a chair back whose shape changes dynamically throughout reclination as the base is held steady, according to embodiments of the present invention. FIG. 11 depicts the chair back toward the beginning of reclination, according to embodiments of the present invention. As can be seen in FIG. 11, the shape of the outer frame 114 and thus the mesh and/or fabric extending therebetween changes during reclining, to provide increased curvature and/or lumbar support during reclining. A center support member 1210, such as, for example, a V-shaped support member, may optionally be used to span the left and right sides of outer frame 114 to maintain any desired separation between the left and right sides of outer frame 114 and thus to provide a desired level of support, according to embodiments of the present invention.

FIG. 10 illustrates a chair with a seat 870, seat attachment members 832, a flexible frame member 114 having a first portion 152 attached to the rigid support member 116 and a second portion 150 that is free to flex with respect to the rigid support member 116, according to embodiments of the present invention. A mesh or mesh fabric 160 at least partially spans the frame 114, according to embodiments of the present invention. As illustrated in FIG. 5, the point 550 at which the flexible frame member 114 contacts the seat attachment member 832 may include various forms of coupling, according to embodiments of the present invention. According to some embodiments of the present invention, the seat attachment member 832 is merely in contact with the flexible frame member 114 at contact area 550 to create increasing curvature in the flexible frame member 114 as the back 116 reclines. According to other embodiments of the present invention, the seat attachment member 832 is pivotably coupled with the flexible frame member 114 at pivot point 550. According to yet other embodiments of the present invention, the seat attachment member 832 is rigidly coupled with the flexible frame member 114 at coupling point 550. Alternatively, the seat attachment member 832 may be formed integrally with the seat 820 and/or with the flexible frame member 114, according to embodiments of the present invention. According to some embodiments of the present invention, the pivot or coupling point or points 850 may be located at any location along flexible frame member 114 which permits the flexible frame member 114 to curve as the back 116 reclines; as such, the location at which the flexible frame member 114 attaches to the seat 104, the seat attachment member 832, and/or another chair element need not be only along the sides or bottom perimeter of flexible frame member 114.

According to some embodiments of the present invention, outer frame 114 may be constructed with a thermoplastic elastomer such as, for example, a Dupont Hytrel material. Outer frame 114 may thus provide support to a user's back while being flexible enough to assume a more curved position while the chair is reclined. The support member 116 may be constructed with aluminum and/or a glass-filled nylon, according to embodiments of the present invention. The mesh installed across the outer frame 114 and against which a user's back rests may be constructed with Dupont Hytrel and polyester fibers, or other elastomeric materials, according to embodiments of the present invention. The springs 832 may be constructed with an acetal copolymer, such as, for example a Ticona Celcon acetal copolymer, according to embodiments of the present invention.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A chair with a chair back, the chair comprising:

a chair base;

a flexible frame member comprising a flexible frame and a mesh element, the mesh element at least partially spanning the flexible frame, and the flexible frame being comprised of an upper portion, an intermediate portion adapted to support a lumbar region of a user, and a lower portion;

a plurality of resilient seat attachment members directly and fixedly coupled to the lower portion of the flexible frame member and directly and fixedly coupled to a seat, the seat being coupled to the chair base such that during reclining of the chair back, the seat at least translates backward relative to a rigid support member pivot point, the backward translation causing seat attachment members and the lower portion of the flexible frame member to at least translate backward in synchronization with the seat, the seat attachment members being free from any contact with the intermediate portion and the upper portion of the flexible frame member; and a rigid support member affixed to the upper portion of the flexible frame member such that the intermediate portion of the flexible frame member is defined between where the rigid support member couples to the flexible frame member and where the seat attachment members couple to the flexible frame member outwardly of the rigid support member, the rigid support member being reclinably attached to the chair base at the rigid support member pivot point and independent of the seat attachment members, the rigid support member being free to reline about the rigid support member pivot point, the flexible frame member, the attachment members, and the rigid support member being configured such that during reclining of the chair back, the upper portion of the flexible frame member moves with the rigid support member and the lower portion of the flexible frame member moves with the seat attachment members and the seat such that a degree of curvature of the intermediate portion of the flexible frame member increases while remaining free from any contact with the rigid support member and the at least one seat attachment member during reclining of the chair back.

2. The chair back of claim 1, wherein the seat attachment members are formed integrally with the flexible frame member.

3. The chair back of claim 1, wherein the flexible frame is an outer frame, and wherein the mesh element is configured to contact a user's back.

4. The chair back of claim 1, wherein the intermediate portion of the flexible frame member dynamically adjusts to match increasing curvature of a user's lumbar back region during reclining.

5. The chair of claim 1, and further comprising:

a linkage assembly coupled to the rigid support member and to the seat.

6. The chair of claim 1, and further comprising:

a linkage assembly coupled to the rigid support member and to the seat, the linkage assembly configured to rotate the entire seat upwardly and toward the back with respect to the rigid support member pivot point during reclining of the chair back.

7. The chair of claim 1, wherein the lower portion of the flexible frame is coupled to at least one of the seat attachment members at a flexible frame contact position and the rigid support member is affixed to the flexible frame at a rigid support member contact position that is located behind the flexible frame contact position when the rigid support member is in both upright and reclined positions.

8. The chair of claim 1, wherein the seat attachment members comprise an attachment portion that is elongated in a forward and backward direction corresponding generally to a sitting direction.

9. The chair of claim 1, wherein the rigid support member comprises a rigid material selected from a group consisting of aluminum and glass-filled nylon, wherein the flexible frame comprises an outer frame comprising a flexible thermoplastic elastomer, wherein the seat attachment members comprise an acetal copolymer.

10. The chair of claim 1, wherein the rigid support member is affixed to the seat attachment members via the flexible frame at a rigid support member contact position that is located behind a flexible frame contact position when the rigid support member is in both upright and reclined positions.

11. The chair back of claim 1, wherein the at least one seat attachment members are directly coupled to a bottom portion of the flexible frame member, the bottom portion extending laterally between two side portions of the flexible frame member.

12. A chair comprising:

a base;

a seat pivotably coupled to the base such that, during reclining of the back about the base, the seat at least translates backward relative to a rigid support member pivot point;

a back comprising a rigid support member and a flexible frame member, the back having an intermediate portion, the rigid support member pivotably coupled to the base at the rigid support member pivot point, the flexible frame member having an upper portion above the intermediate portion and a lower portion below the intermediate portion, wherein the upper portion is coupled to the rigid support member and the lower portion is coupled to the seat; and a linkage assembly coupled to the back and to the seat, the linkage assembly configured to rotate the entire seat upwardly and toward the back with respect to the rigid support member pivot point during reclining of the back about the base, the linkage assembly being separated from the rigid support member;

wherein the lower portion of the flexible frame member travels at least toward the back in synchronization with the seat during its rotation and wherein the rigid support member is adapted to rotate simultaneously but at a different rate than the seat, and wherein the lower portion of the flexible frame member is coupled to the seat by a plurality of resilient seat attachment members spaced laterally outward from the rigid support member, each resilient seat attachment member fixedly coupled to the seat and fixedly coupled to the lower portion of the flexible frame member.

13. The chair of claim 12, wherein the seat attachment member is a spring.

14. The chair of claim 12, further comprising:

a mesh element at least partially spanning the flexible frame member.

15. The chair of claim 12, further comprising:

a polymer element at least partially spanning the flexible frame member.

16. The chair of claim 12, wherein the linkage assembly couples the back to the seat such that the seat rotates upwardly and toward the back at a different rate than the rigid support member during reclining of the rigid support member.

17. The chair of claim 12, wherein the rigid support member comprises a rigid material selected from a group consisting of aluminum and glass-filled nylon, and wherein the flexible frame member comprises an outer frame comprising a flexible thermoplastic elastomer.

18. A chair, comprising:

a back comprising a rigid support member reclinably attached to a chair base at a rigid support member attachment point;

a flexible frame member comprising a flexible frame and a mesh element, the mesh element at least partially spanning the flexible frame, the flexible frame member having an upper portion, an intermediate portion, and a lower portion, wherein the rigid support member is rigidly coupled to the upper portion;

a plurality of resilient seat attachment members each rigidly coupled to a seat and each rigidly coupled to the lower portion of the flexible frame member laterally outward from the rigid support member, the seat attachment members each being free from contact with the intermediate portion of the back that is adapted to contact a user's lumbar region; and a linkage assembly coupled to the rigid support member and to the seat, the seat sliding upward and backward with respect to the rigid support member attachment point at a different rate than the rigid support member during reclining of the rigid support member, the resilient seat attachment members and the lower portion of the flexible frame member traveling at least backward in synchronization with the seat during reclining.

19. The chair of claim 18, wherein the seat attachment members are springs.

20. The chair of claim 18, wherein the seat attachment members are part of a core assembly.

21. The chair of claim 18, wherein a first portion of the flexible frame member is affixed to the rigid support member, wherein a second portion of the flexible frame member flexes freely with respect to the rigid support member, wherein at least one of the resilient seat attachment members is rigidly coupled to at least part of the second portion of the flexible frame member, wherein the first portion moves with the rigid support member such that a degree of curvature of the second portion increases as the rigid support member reclines.

22. A chair comprising:

a base;

a seat pivotally coupled to the base such that, during reclining, the seat at least translates backward relative to a rigid support member pivot point;

a back having a frame member and an intermediate portion, the frame member fixedly coupled to a rigid support member above the intermediate portion, the rigid support member being directly pivotally coupled to the base at the rigid support member pivot point and independent of the seat; and a plurality of resilient seat attachment members each directly and rigidly coupled to the seat and directly and rigidly coupled to the back below the intermediate portion laterally outward from the rigid support member, the seat attachment members being free from contact with the intermediate portion of the back, which intermediate portion is adapted to contact a user's lumbar region, so that a portion of the frame member travels in synchronization with the seat and the resilient seat attachment member as they translate backward relative to the rigid support member pivot point and the seat and the resilient seat attachment member rotate about the base at a different rate than the rigid support member rotates about the base.

23. The chair of claim 22, wherein the resilient seat attachment members are directly coupled to a lower portion of the frame member of the back and wherein the lower portion of the frame member travels along with the seat as it rotates about the base at a different rate than the rigid support member rotates about the base.

24. The chair of claim 22, wherein the frame member is rigidly coupled to the rigid support member.

25. The chair of claim 22, wherein the rigid support member is pivotally coupled to the base at a first pivot point and the seat is pivotally coupled to the base at a second pivot point and at a third pivot point.

* * * * *